US005765397A

United States Patent [19]

Honda et al.

[11] Patent Number: 5,765,397

[45] Date of Patent: Jun. 16, 1998

[54] AIR LIQUEFACTION SEPARATION PROCESS AND APPARATUS THEREFOR

[75] Inventors: Hideyuki Honda; Yasuharu Kishida, both of Kanagawa, Japan

[73] Assignee: Nippon Sanso Corporation, Tokyo, Japan

[21] Appl. No.: 763,301

[22] Filed: Dec. 10, 1996

[30] Foreign Application Priority Data

Oct. 28, 1996 [JP] Japan ..... 8-285385

[51] Int. Cl.[6] ..... F25J 1/00

[52] U.S. Cl. ..... 62/646; 62/654

[58] Field of Search ..... 62/646, 654

[56] References Cited

U.S. PATENT DOCUMENTS 3,059,439 10/1962 First et al. ..... 62/654

3,416,323 12/1968 Heinik .

*Primary Examiner*—Ronald C. Capossela

*Attorney, Agent, or Firm*—Armstrong, Westerman, Hattori, McLeland & Naughton

[57] ABSTRACT

The present invention relates to an air liquefaction separation apparatus whose power cost is reduced. A low-pressure column of a double rectification column has a cleaning section at a lower position, and a liquid oxygen is partly withdrawn from the space above the cleaning section so as to supply it to a main condenser-evaporator. The liquid oxygen supplied to the main condenser-evaporator is subjected to heat exchange with a nitrogen gas separated at the head of a high-pressure column to be gasified into an oxygen gas. This oxygen gas is introduced to the space under the cleaning section. Hydrocarbons contained in the oxygen gas ascending through the cleaning section are removed by the rest of the liquid oxygen descending through the cleaning section to provide a clean oxygen gas. The liquid oxygen passed through the cleaning section is withdrawn from the low-pressure column. Thus, since the hydrocarbons are prevented from being concentrated highly to or over critical levels in the liquid oxygen in the main condenser-evaporator, submergence in the main condenser-evaporator can be reduced to minimize the influence of the depth of the liquid, thus improving heat exchange efficiency to lower the pressure of the nitrogen gas, as well as, to reduce operating cost by reducing power of the compressor for compressing the feed air.

11 Claims, 4 Drawing Sheets

AIR LIQUEFACTION SEPARATION PROCESS AND APPARATUS THEREFOR

BACKGROUND OF THE INVENTION AND RELATED ART STATEMENT

The present invention relates to an air liquefaction separation process and an apparatus therefor. More particularly, the present invention relates to an air liquefaction separation process, in which a compressed, purified and cooled feed air is introduced to a double rectification column where it is liquefied, rectified and separated to provide oxygen gas, nitrogen gas, liquid oxygen, liquid nitrogen, argon products, etc. and also to an apparatus therefor.

U.S. Pat. No. 3,416,323 discloses an example of air liquefaction separation process for collecting an oxygen product by liquefaction, rectification and separation. According to this separation process, after a compressed feed air is purified in an adsorptive purification unit and cooled by a heat exchanger, it is introduced to a high-pressure column of a double rectification column. The feed air introduced to the high-pressure column is rectified there to separate nitrogen gas at the head and oxygen-rich liquefied air at the sump respectively in the high-pressure column. This oxygen-rich liquefied air is withdrawn from the sump of the column to be introduced via an expansion valve to a middle section of a low-pressure column.

Meanwhile, the overhead nitrogen gas in the high-pressure column is subjected to heat exchange in a main condenser-evaporator with the liquid oxygen at the sump of the low-pressure column and liquefied. The thus formed liquid nitrogen is partly passed through an expansion valve to be introduced to the head of the low-pressure column. The rest of liquid nitrogen becomes a reflux liquid of the high-pressure column.

In the low-pressure column, liquid oxygen and nitrogen gas are separated at the sump and at the head of the columns respectively by the rectifying operation. The nitrogen gas is withdrawn from the head of the column and is subjected to heat exchange in a main heat exchanger with the feed air to be warmed before it is discharged.

The liquid oxygen at the sump of the low-pressure column is subjected to heat exchange in the main condenser evaporator with the overhead nitrogen gas in the high-pressure column to be converted into an oxygen gas. The oxygen gas forms an upward gas stream in the low-pressure column. Further, the liquid oxygen at the sump of the low-pressure column is partly withdrawn from the bottom of the column, and after boosting by a pump it is subjected to heat exchange with the feed air in the main heat exchanger to be gasified and warmed before it is discharged.

Substances contained in very small amounts in air, for example, hydrocarbons such as methane, ethane and propane, are liable to explode when the concentration thereof exceeds a predetermined level in a high oxygen atmosphere. However, it is difficult to completely remove such substances in ordinary adsorption-purification unit or by reversible heat exchangers, and they are contained and concentrated in the liquid oxygen at the sump of the low-pressure column by said rectification operation.

More specifically, in the adsorption-purification unit as described above, hydrocarbons having four or more carbon atoms and acetylene can be removed substantially completely, but it is difficult to fully remove methane, ethane and propane under the present circumstances. Meanwhile, referring to the reversible heat exchanger, hydrocarbons remain in the feed air in vapor pressure amounts at the cold end temperature of the heat exchanger.

Accordingly, heat transfer surface of the main condenser-evaporator must have been constantly washed conventionally with liquid oxygen so that such hydrocarbons may not be deposited on it, and for such purpose, a large amount of liquid oxygen is stored at the sump of the low-pressure column to increase submergence (liquid level of liquid oxygen for the main condenser-evaporator block so as to increase the oxygen flow rate (circulating ratio) in the heat exchanger block (core). This is true with the main condenser-evaporator whether it is provided outside or inside the double rectification column.

However, if submergence is increased, the gasification temperature of the liquid oxygen at the bottom of the main condenser-evaporator is affected by the liquid head to be elevated, so that the average temperature difference between the liquid oxygen and the nitrogen gas must be increased and that the pressure of nitrogen gas must be increased to keep the temperature difference. Accordingly, if the pressure in the high-pressure column is increased, the pressure of the feed air to be introduced thereto must be increased, leading to rise in the power consumption of operating a compressor.

OBJECT AND SUMMARY OF THE INVENTION

It is an objective of the present invention to provide an air liquefaction separation process which can prevent hydrocarbons from being contained at high concentration values in liquid oxygen in a main condenser-evaporator and can achieve reduction in the operating cost, as well as, an apparatus therefor.

A first aspect of the present invention relates to an air liquefaction separation process containing a compression step of compressing a feed air; a purification step of purifying the compressed feed air; a cooling step of cooling the purified feed air; a rectifying step of introducing the cooled feed air to a double rectification column to effect liquefaction, rectification and separation; a condensation-evaporation step of subjecting a nitrogen gas separated at the head of a high-pressure tower of the double rectification column and a liquid oxygen separated to the sump of a low-pressure column of the double rectification column to heat exchange with each other in a main condenser-evaporator to effect liquefaction of the nitrogen gas and gasification of the liquid oxygen; wherein the low-pressure column has a cleaning section (the section where hydrocarbons are removed by rectification) at a lower position; the liquid oxygen is partly withdrawn from a space above the cleaning section to be supplied to the main condenser-evaporator where it is substantially entirely gasified without circulation of liquid flow; the oxygen gas formed in the main condenser-evaporator is introduced to a space under the cleaning section so as to clean the oxygen gas ascending through the cleaning section by bringing it into contact with the rest of liquid oxygen descending through the cleaning section so as to remove hydrocarbons contained in the oxygen gas; and the liquid oxygen passed through the cleaning section is withdrawn from the low-pressure column.

In the first aspect of the invention, the liquid oxygen withdrawn from the sump of the low-pressure column can be boosted by a pump, gasified and warmed to be discharged as a product oxygen gas having a predetermined pressure.

In the first aspect of the invention, the liquid oxygen withdrawn from the sump of the low-pressure column can be gasified by introducing it to a sub condenser-evaporator disposed independent of the main condenser-evaporator, thus enabling gasification of liquid oxygen fully with a nitrogen gas having a low pressure compared with the prior art.

According to the first aspect of the invention, the liquid level of liquid oxygen in the main condenser-evaporator can be set at the height of or lower, preferably 50% or less than the heat exchanger block in the main condenser-evaporator.

A second aspect of the present invention relates to an air liquefaction separation apparatus containing compressing means for compressing a feed air; purifying means for purifying the compressed feed air; cooling means for cooling the purified feed air; a double rectification column where the cooled feed air is subjected to liquefaction, rectification and separation; and a main condenser-evaporator where a nitrogen gas separated at the head of a high-pressure column of the double rectification column and a liquid oxygen separated to the sump of a low-pressure column of the double column are subjected to heat exchange to effect liquefaction of the nitrogen gas and gasification of the liquid oxygen; wherein a cleaning section for cleaning the oxygen gas by washing it with the liquid oxygen to remove hydrocarbons contained in the oxygen gas is located at a lower position in the low-pressure column; a liquid oxygen supply passage for withdrawing partly the liquid oxygen flowing down through the low-pressure column to supply it to the main condenser-evaporator is located above the cleaning section; an oxygen gas introducing passage for introducing the oxygen gas formed in the main condenser-evaporator to the space under the cleaning section is provided below the cleaning section; and a liquid oxygen withdrawing passage for withdrawing the liquid oxygen passed through the cleaning section is located below the cleaning section.

In the second aspect of the invention, the cleaning section can be constructed easily by using a rectifying tray (sieve tray) or a packing, etc.

In the second aspect of the invention, the apparatus may be further provided on the liquid oxygen withdrawing passage a pump for boosting the liquid oxygen, a heat exchange passage for achieving gasification and warming of the liquid oxygen boosted by the pump and an oxygen gas discharge passage for discharging the thus gasified and warmed oxygen gas so as to provide a product oxygen gas boosted to a predetermined pressure.

In the second aspect of the invention, the main condenser-evaporator can be disposed out of the high-pressure column and the low-pressure column.

In the second aspect of the invention, a sub condenser-evaporator for gasifying the liquid oxygen to form an oxygen gas may be disposed on the liquid oxygen withdrawing passage, and thus gasification of liquid oxygen can be fully achieved using a nitrogen gas having a low pressure compared with the prior art.

In the second aspect of the invention, the liquid oxygen withdrawing passage may have a flow control valve for controlling the amount of liquid oxygen to be supplied, and thus submergence can be controlled.

As described above, according to the present invention, since hydrocarbons are prevented from being contained over predetermined levels in the liquid oxygen in the main condenser-evaporator, the heat transfer surface of the main condenser-evaporator need not be washed with liquid oxygen. Accordingly, substantially the entire amount of liquid oxygen at the outlet of the main condenser-evaporator can be gasified. Thus, since the influence of the liquid depth can be minimized by reducing submergence, the power of the compressor for compressing the feed air, in turn, the operating cost can be reduced. As described above, since there is no need of worrying about cleaning of the heat transfer surface of the main condenser-evaporator, the liquid oxygen may be entirely gasified or may assume a form of gas carrying mist-like liquid at the outlet of the main condenser-evaporator.

DETAILED DESCRIPTION OF THE PREFERRED EMBODIMENTS

Preferred embodiments of the present invention will be described more specifically referring to the attached drawings.

Figure 1:
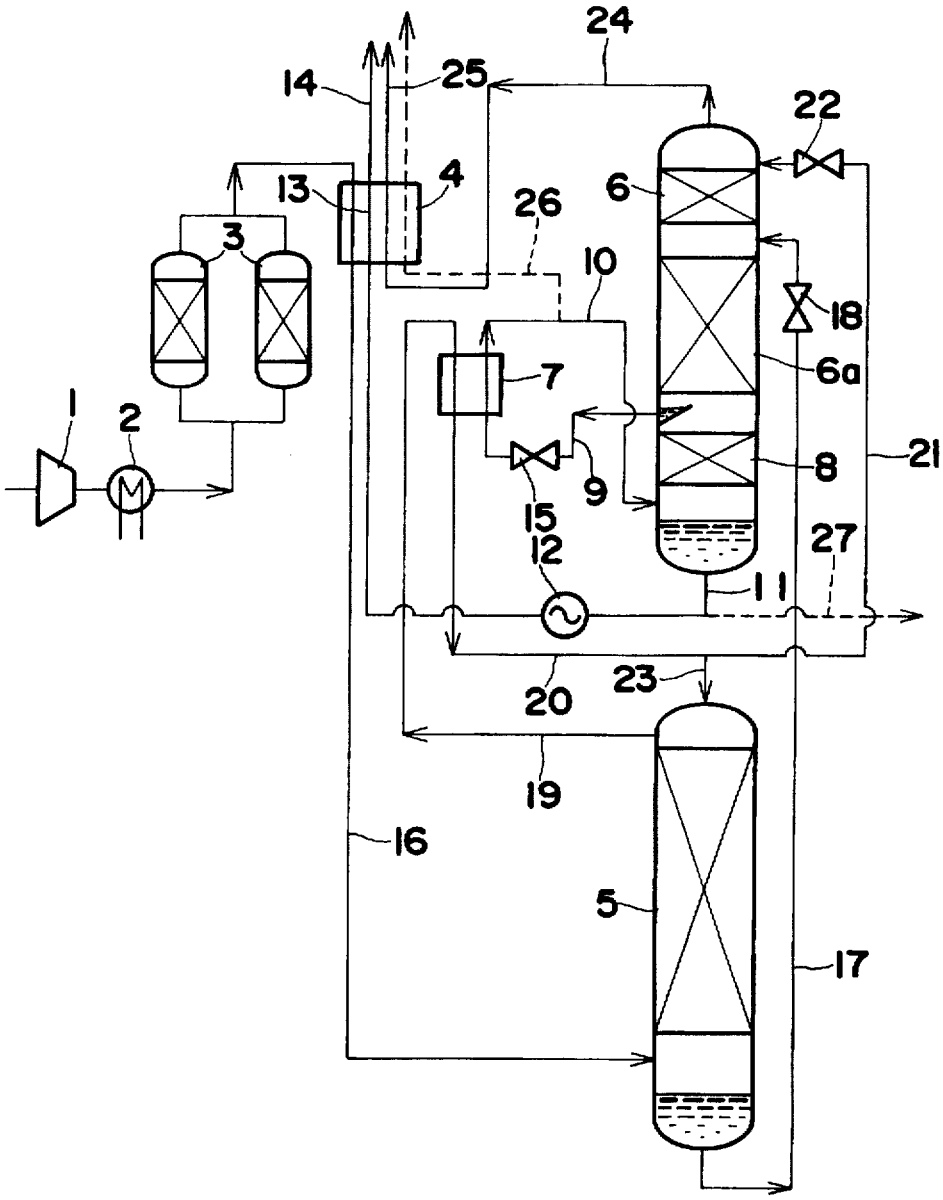
FIG. 1 is a schematic diagram of an air liquefaction separation apparatus according to a first preferred embodiment of the invention.

FIG. 1 shows a first embodiment of the present invention.

The air liquefaction separation apparatus shown in FIG. 1 contains a compressor 1 for compressing a feed air; an after-cooler 2 for cooling the feed air compressed by the compressor 1 to a normal temperature; an adsorber 3 for purifying the feed air cooled by the after-cooler 2 by adsorbing moisture, carbon dioxide, etc. contained therein; a main heat exchanger 4 for cooling the feed air purified in the adsorber 3 substantially to the liquefying temperature; and a double rectification column, having a high-pressure column 5, a low-pressure column 6 and a main condenser-evaporator 7, which performs liquefaction, rectification and separation of the feed air cooled by the main heat exchanger 4.

The high-pressure column 5 performs rectifying operation to separate nitrogen gas and oxygen-rich liquefied air at the head and at the sump respectively. The low-pressure column 6 performs rectifying operation to separate liquid oxygen and nitrogen gas at the sump and at the head respectively. The main condenser-evaporator 7, which is located out of the high-pressure column 5 and the low-pressure column 6, performs heat exchange between the nitrogen gas at the head of the high-pressure column 5 and the liquid oxygen at the sump of the low-pressure column 6 to effect liquefaction of the nitrogen gas to provide a liquid nitrogen and also gasification of the liquid oxygen to provide an oxygen gas.

It should be noted here that the nitrogen gas at the head of the high-pressure column 5 is not limited to the nitrogen gas present at the top of the high-pressure column 5, but it means also the high-purity nitrogen gas present at the rectifying section several stages lower than the top of the column 5 when migration of helium, hydrogen, neon, etc. highly concentrated at the top of the column 5 is to be avoided.

The low-pressure column 6 has at a lower position a cleaning section 8 where the oxygen gas flowing up through the column 6 and the liquid oxygen flowing down through the column 6 are brought into gas-liquid contact with each other to remove hydrocarbons contained in the oxygen gas by washing with the liquid oxygen. The cleaning section 8 is constructed of a rectifying tray or a packing, etc.

A liquid oxygen supply passage 9 is connected to the low-pressure column 6 at a position upper than the cleaning section 8. This passage 9 is for withdrawing the liquid oxygen partially from the column 6 and supplying it to the main condenser-evaporator 7. An oxygen gas introducing passage 10 is connected to the low-pressure column 6 at a position lower than the cleaning section 8. This passage 10 is for introducing the oxygen gas formed in the main condenser-evaporator 7 to the column 6. A liquid oxygen withdrawing passage 11 is connected to the bottom of the low-pressure column 6 where the liquid oxygen having passed through the cleaning section 8 is stored. This passage 11 is for withdrawing the liquid oxygen to the outside of the column.

The liquid oxygen withdrawing passage 11 is provided with a pump 12 for boosting the liquid oxygen; a heat exchange passage 13 for introducing the liquid oxygen boosted by the pump 12 to the main heat exchanger 4 to effect gasification and warming; and an oxygen gas discharge passage 14 for discharging the thus formed and warmed oxygen gas.

The liquid oxygen supply passage 9 is provided with a flow control valve 15 for controlling the amount of liquid oxygen to be supplied to the main condenser-evaporator 7.

The feed air compressed by the compressor 1 is cooled by the after-cooler 2 and then introduced to the adsorber 3. The feed air purified by the adsorber 3 is subjected to heat exchange in the main heat exchanger 4 with the returning gas to be cooled substantially to the liquefying temperature to be partially liquefied and then introduced through a passage 16 to the sump of the high-pressure column 5.

The oxygen-rich liquefied air separated to the sump of the high-pressure column 5 is withdrawn to a passage 17 connected to the bottom of the column 5, and after pressure reduction through a valve 18, it is introduced to the middle section of the low-pressure column 6. The nitrogen gas separated to the head of the high-pressure column 5 is withdrawn to a passage 19 connected to the top of the column 5 to be introduced into the main condenser-evaporator 7.

The liquid nitrogen formed in the main condenser-evaporator 7 is withdrawn to a passage 20, and after it is partly passed through a passage 21 and subjected to pressure reduction through a valve 22, it is introduced to the head of the low-pressure column 6. The rest of the liquid nitrogen passes through a passage 23 branched out of the passage 20 to be introduced to the head of the high-pressure column.

The nitrogen gas separated to the head of the low-pressure column 6 is withdrawn to a passage 24 to be introduced to the main heat exchanger 4. The nitrogen gas is subjected to heat exchange with the feed air in the main heat exchanger 4 to be warmed and then withdrawn to the passage 25.

The liquid oxygen separated to the lower position of the low-pressure column 6 is partly withdrawn from the upper portion of the cleaning section 8 to the liquid oxygen supply passage 9 to be introduced into the main condenser-evaporator 7. The oxygen gas formed in the main condenser-evaporator 7 passes through the oxygen gas introducing passage 10 to the space under the cleaning section 8. The oxygen gas is partly diverted, if necessary, from the gas introducing passage 10 to a passage 26, and after heating by the main heat exchanger 4 it can be collected as a low pressure product oxygen gas.

The rest of liquid oxygen flows down through the cleaning section 8 to be brought into gas-liquid contact with the oxygen gas flowing up through the cleaning section 8, whereby to remove hydrocarbons contained in the oxygen gas. The liquid oxygen in which hydrocarbons are dissolved by this cleaning operation is withdrawn from the bottom of the low-pressure column 6 to the liquid oxygen withdrawing passage 11. After the liquid oxygen withdrawn to the liquid oxygen withdrawing passage 11 is boosted by the pump 12, it is introduced to the main heat exchanger 4, where it is gasified and warmed and then discharged through the oxygen gas discharge passage 14. The liquid oxygen withdrawn to the liquid oxygen withdrawing passage 11 can be partly diverted therefrom to a passage 27 to be discharged therefrom.

Incidentally, in order to produce make-up refrigeration necessary for the operation of the air liquefaction separation apparatus, an expansion turbine (not shown) may be disposed on the passage 16 or 19 to produce refrigeration by adiabatic expansion. For example, a part of the air passed through the adsorber 3 may be further increased in the pressure and subjected to heat exchange with the liquid oxygen from the pump 12 to be liquefied before introduction to the high pressure column 5, although this case is not illustrated.

The first embodiment described above will be described more specifically.

The feed air (e.g., 10,000 $Nm^3/h$), having been compressed by the compressor 1 to 5 $kg/cm^2G$, passed through the after-cooler 2, purified through the adsorber 3 and cooled by the main heat exchanger 4, is introduced to the high-pressure column 5, and then rectified by the high-pressure column 5 and the low-pressure column 6. Although it depends on the atmospheric conditions, this feed air contains at the outlet of the adsorber 3 about 2 ppm of methane, about 0.02 ppm of ethane and about 0.02 ppm of propane under general atmospheric conditions.

At the head of the low-pressure column 6, hydrocarbons are removed from the ascending gas to be included in the descending liquid; at the middle and lower sections of the column 6, most of hydrocarbons contained in the feed gas is transferred to the descending liquid (ca. 8,500 $Nm^3/h$). Thus, the descending liquid comes to contain, for example, about 2.35 ppm of ethane, about 0.024 ppm of ethane and about 0.024 ppm of propane.

The liquid oxygen containing the hydrocarbons flows down from the lower end of a rectifying section 6*a* in the low-pressure column 6, and the greatest part of it, for example, about 76% (6,500 $Nm^3/h$) of the descending liquid is withdrawn through the liquid oxygen supply passage 9 under control of flow rate thereof by the flow control valve 15 to be supplied as an ascending stream to the main condenser-evaporator 7. The liquid oxygen supplied to the main condenser-evaporator 7 is subjected to heat exchange with the nitrogen gas introduced through the passage 19 thereto to be entirely gasified into an oxygen gas. In this process, very small amounts of hydrocarbons such as methane, ethane, propane, etc. contained in the liquid oxygen are gasified together with the liquid oxygen. The thus formed oxygen gas containing the gasified hydrocarbons passes through the oxygen gas introducing passage 10 to the space under the cleaning section 8.

While the liquid oxygen introduced to the main condenser-evaporator 7 is preferably gasified entirely, it may be partly introduced as such through the oxygen gas introducing passage 10 to the space under cleaning section 8. In this case, the maximum amount of the ungasified liquid shall be about 24% (200 $Nm^3/h$) of the descending liquid (fluid volume of passage 11) in total including the liquid flowing down through the cleaning section 8.

At the cleaning section 8 of the low-pressure column 6, about 24% (2,000 $Nm^3/h$) of the liquid oxygen flowed down from the rectifying section 6a and the oxygen gas introduced through the oxygen gas introducing passage 10 are brought into gas-liquid contact with each other, and the hydrocarbons contained in the oxygen gas are dissolved in the liquid oxygen to a methane concentration of, for example, about 10 ppm, an ethane concentration of about 0.1 ppm and a propane concentration of about 0.1 ppm. The resulting liquid oxygen flows down to the sump of the low-pressure column 6. The liquid oxygen is withdrawn at a rate of 2,000 $Nm^3/h$ from the sump of the column 6 to the liquid oxygen withdrawing passage 11, and after compression by the pump 12, for example, to 10 $kg/cm^2$, it is passed through the main heat exchanger 4 to be discharged through the oxygen gas discharge passage 14.

The heat exchanger for gasifying and warming the liquid oxygen boosted by the pump 12 may not be the main heat exchanger 4 but may be provided separately. Meanwhile, the fluid to be subjected to heat exchange may not be limited to air but a boosted nitrogen gas may be employed. Further, the liquid oxygen withdrawn to the liquid oxygen withdrawing passage 11 may be discharged without boosting.

In the above procedures, while a liquid oxygen having a pressure of 10 $kg/cm^2G$ is gasified in the main heat exchanger 4, the boiling point of oxygen under the pressure 10 $kg/cm^2G$ is −141° C. Partial pressure values of the hydrocarbons at this temperature are as follows: methane 4.3 $kg/cm^2G$ abs, ethane 0.018 $kg/cm^2G$ abs and propane $3\times10^{-4}$ $kg/cm^2G$ abs. Accordingly, saturated concentration values of these hydrocarbons in the 10 $kg/cm^2G$ oxygen gas are: methane 39%, ethane 0.16% and propane 27 ppm. Since these concentration values are extremely higher than the actual values, these hydrocarbons are gasified and carried by the oxygen gas to be discharged together with the product: oxygen gas through the oxygen gas discharge passage 14.

As described above, the hydrocarbons contained in the oxygen gas can be removed by cleaning the ascending oxygen gas through the cleaning section 8 of the low-pressure column 6 with a part of the liquid oxygen descending the column 6. Accordingly, the amount of hydrocarbons at the rectifying section 6a of the low-pressure column 6, i.e. the concentration of hydrocarbons in the liquid oxygen to be supplied to the main condenser-evaporator 7 can be approximated to the concentration at the outlet of the adsorber 3.

Since the concentration values of hydrocarbons in the liquid oxygen to be supplied to the main condenser-evaporator 7 can be lowered, as described above, the hydrocarbons can be entirely gasified. Thus, since the hydrocarbons are prevented from accumulating in the main condenser-evaporator 7, there is no need of increasing submergence so as to wash the heat transfer surface of the main condenser-evaporator 7 with liquid oxygen. Accordingly, since submergence of the main condenser-evaporator 7 can be set at a low level, the main condenser-evaporator 7 can be operated under the dry mode where the liquid oxygen is fully gasified at the core outlet of the oxygen passage of the main condenser-evaporator 7, and the liquid level of the liquid oxygen can be lowered at a lower position of the main condenser-evaporator 7.

In other words, the liquid level of the liquid oxygen in the main condenser-evaporator 7 can be set to 50% or less of the total height of the core of the main condenser-evaporator 7. For example, in the case where the total core height is about 2,000 mm, a submergence of about 2,000 mm is necessary in the prior art. However, it can be reduced to about 0 to 200 mm.

By setting submergence of the main condenser-evaporator 7 to a low level, as described above, the rise in the temperature depending on the liquid depth of the liquid oxygen in the main condenser-evaporator 7 can be minimized, and thus the pressure of the nitrogen gas at the head of the high-pressure column to be subjected to heat exchange with the liquid oxygen, i.e. the compression pressure of the feed air, can be reduced, leading to reduction in the unit power consumption requirement.

Figure 2:
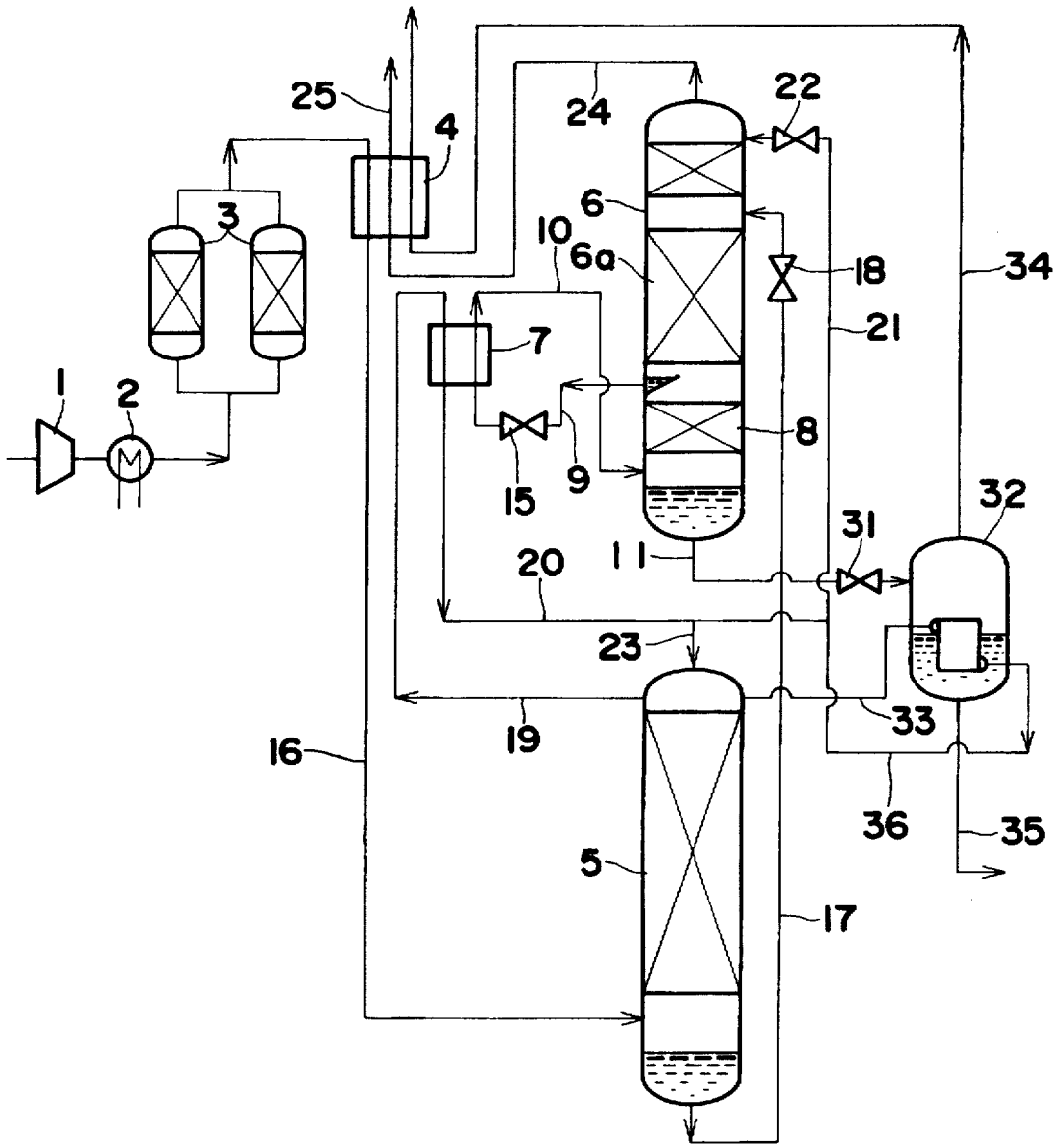
FIG. 2 is a schematic diagram of an air liquefaction separation apparatus according to a second embodiment of the invention.

FIG. 2 shows a second embodiment of the present invention. It should be noted here that the same elements as in the first embodiment are affixed with the same reference numbers respectively, and detailed description thereof will be omitted.

The air liquefaction separation apparatus according to this embodiment has a sub condenser-evaporator 32 connected downstream to the liquid oxygen withdrawing passage 11 via a pressure reducing valve 31 so that the liquid oxygen may be gasified in the sub condenser-evaporator 32 utilizing the nitrogen gas withdrawn from the head of the high-pressure column 5 to a passage 33 as a heat source.

The liquid oxygen having a pressure of, for example, 2000 $Nm^3/h$ withdrawn from the sump of the low-pressure column 6 to the liquid oxygen withdrawing passage 11 is introduced to the sub condenser-evaporator 32 after pressure reduction through the pressure reducing valve 31. The liquid oxygen introduced to the sub condenser-evaporator 32 is subjected to heat exchange with the nitrogen gas introduced thereto through the passage 33, and the liquid oxygen in an amount of, for example, 1,980 $Nm^3/h$ is gasified into an oxygen gas to be discharged through the passage 34 and the main heat exchanger 4. The rest of the liquid oxygen (20 $Nm^3/h$) is withdrawn together with hydrocarbons concentrated in the liquid oxygen through the passage 35.

Meanwhile, the nitrogen gas introduced to the sub condenser-evaporator 32 is liquefied into a liquid oxygen and passes through the passage 36 to be combined with the liquid nitrogen passing through the passage 21.

In this instance, since the liquid oxygen to be introduced to the sub condenser-evaporator 32 contains the hydrocarbons concentrated therein, it is necessary to set submergence in the sub condenser-evaporator 32 at a high level. However, difference in the temperature can be secured between the liquid oxygen under the core and the nitrogen gas at the head of the high-pressure column by reducing the pressure of the liquid oxygen through the pressure reducing valve 31 before it is introduced to the sub condenser-evaporator 32, so that the liquid oxygen can be fully gasified using a nitrogen gas having a low pressure compared with the prior art, and the compression pressure of the feed air need not be increased.

Further, since oxygen gas is designed to be obtained by installing the sub condenser-evaporator 32, the heat source for gasifying the liquid oxygen can be selected arbitrarily, and it becomes possible to utilize, for example, a part of feed air to be introduced to the lower part of the high-pressure column or a gas from other lines or other section (such as liquefaction cycle). The liquid level pressure of the liquid oxygen may be set at a level suitable for heat exchange depending on the composition and pressure of the heat source gas. If pressure reduction is not necessary, the pressure reducing valve 31 can be omitted, and the sub condenser-evaporator can be incorporated into the bottom of the high-pressure column.

FIGS. 3 to 6 show other embodiments illustrating oxygen flow about the main condenser-evaporator.

Figure 3:
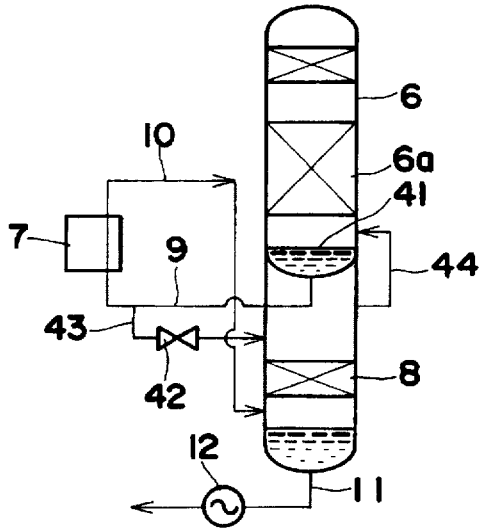
FIG. 3 is a schematic diagram showing major portions in an air liquefaction separation apparatus according to a third embodiment of the invention.

In a third embodiment shown in FIG. 3, a liquid oxygen reservoir 41 is located below the rectifying section 6*a* of the low-pressure column 6 so that the liquid oxygen separated by rectification may be entirely withdrawn to the liquid oxygen supply passage 9 and that a part of it (e.g., 20% of air) may be diverted to a passage 43 having a flow control valve 42 to be introduced to the upper space above the cleaning section 8. Meanwhile, the oxygen gas formed in the main condenser-evaporator 7 is introduced through the oxygen gas introducing passage 10 to the space under the cleaning section 8, and after it is cleaned with the liquid oxygen at the cleaning section 8, it is introduced through the passage 44 to the space under the rectifying section 6*a*.

Figure 4:
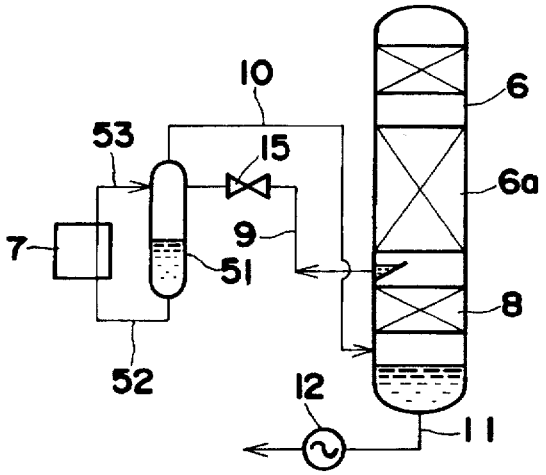
FIG. 4 is a schematic diagram showing major portions in an air liquefaction separation apparatus according to a fourth embodiment of the invention.

In a fourth embodiment shown in FIG. 4, a gas-liquid separator 51 is connected to the liquid oxygen supply passage 9 downstream the flow control valve 15, and the liquid oxygen at the sump of the separator 51 is supplied through a passage 52 to the main condenser-evaporator 7. The oxygen gas formed in the main condenser-evaporator 7 is passed through a passage 53 to be introduced to the head of the gas-liquid separator 51 and further introduced from the top through the oxygen gas introducing passage 10 to the space under the cleaning section 8.

In this case, the liquid level in the separator 51 can be lower than 50% of the main condenser-evaporator's core height, because liquid oxygen may be entirely vaporized at the outlet of the core 62 of the main condenser-evaporator 7.

Figure 5:
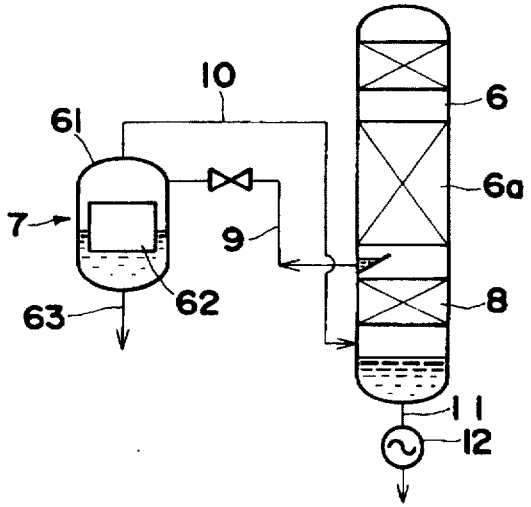
FIG. 5 is a schematic diagram showing major portions in an air liquefaction separation apparatus according to a fifth embodiment of the invention.

In a fifth embodiment shown in FIG. 5, the main condenser-evaporator 7 is of the type where a heat exchanger 62 having a nitrogen gas passage is immersed in liquid oxygen contained in an outer vessel 61. The liquid oxygen withdrawn from the space above the cleaning section 8 passes through the liquid oxygen supply passage 9 and the flow control valve 15 to be supplied to the outer vessel 61, and the oxygen gas formed in the outer vessel 61 is introduced from the top of the outer vessel 61 through the oxygen gas introducing passage 10 to the space under the cleaning section 8. The liquid oxygen can be partly withdrawn through a passage 63 connected to the bottom of the main condenser-evaporator 7. The liquid level in the vessel 61 can be lower than 50% of the main condenser-evaporator's core height, because liquid oxygen may be entirely vaporized at the outlet of the core 62 of the main condenser-evaporator 7.

Figure 6:
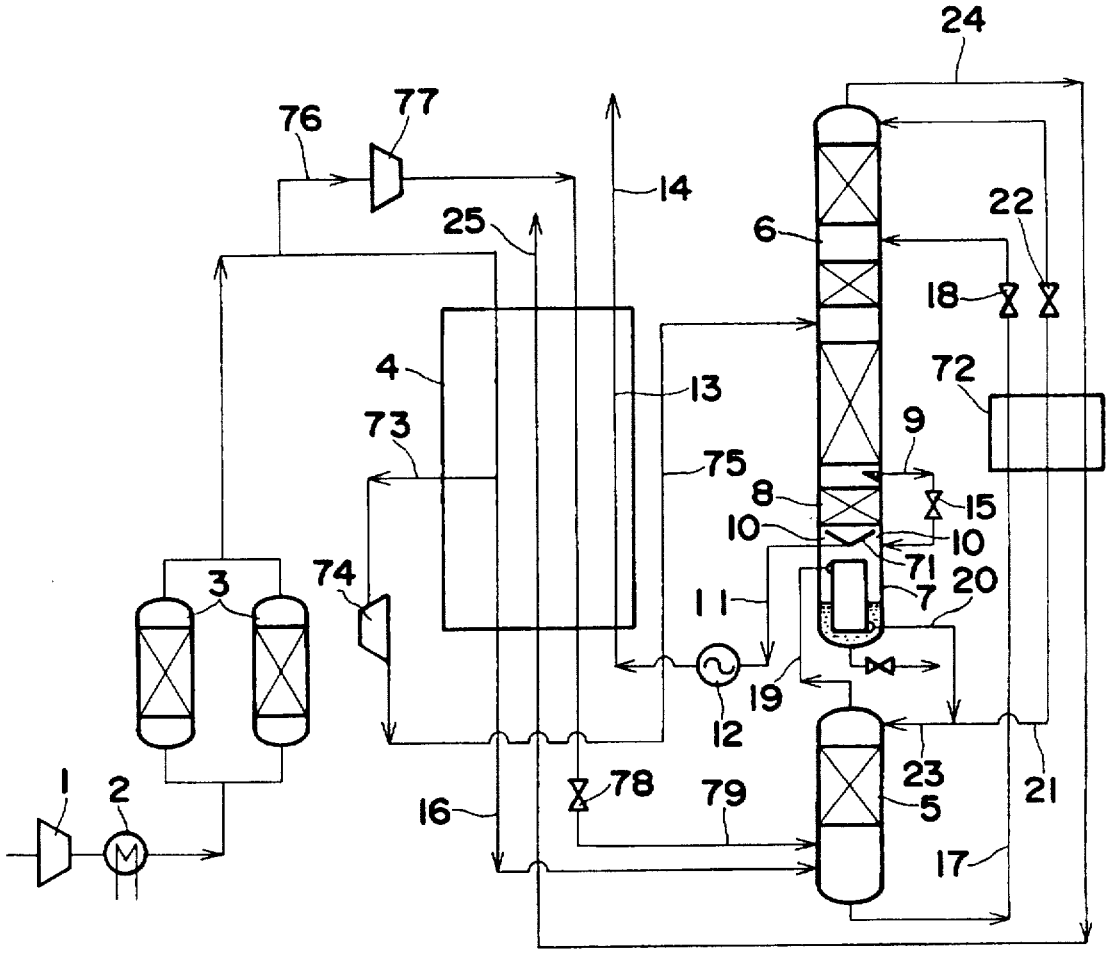
FIG. 6 is a schematic diagram of an air liquefaction separation apparatus according to a sixth embodiment of the invention.

In a sixth embodiment shown in FIG. 6, the main condenser-evaporator 7 is integrated into the bottom of the low-pressure column 6, and the cleaning section 8 is provided above the main condenser-evaporator 7. A liquid reservoir 71 in which the liquid oxygen passed through the cleaning section 8 is to be stored is located below the cleaning section 8. The liquid oxygen withdrawing passage 11 for withdrawing the liquid oxygen to the outside of the column is connected to the liquid reservoir 71. The oxygen gas introducing passage 10 for introducing the oxygen gas formed in the main condenser-evaporator 7 to the space under the cleaning section 8 is located by the liquid reservoir 71.

In this case, the liquid level in the condenser-evaporator 7 can be lower than 50% of the main condenser-evaporator's core height, because liquid oxygen may be entirely vaporized at the outlet of the core 62 of the main condenser-evaporator 7.

In this embodiment, the feed air compressed by the compressor 1 is cooled by the after-cooler 2 and then introduced to the adsorber 3. The feed air purified over the adsorber 3 is subjected to heat exchange with the returning gas in the main heat exchanger 4 to be cooled substantially to the liquefying temperature and introduced through the passage 16 to the sump the high-pressure column 5.

The oxygen-rich liquefied air separated to the sump of the high-pressure column 5 is withdrawn to the passage 17 connected to the bottom of the column 5, passed through a supercooler 72, expanded through the pressure reducing valve 18 and then introduced to the space above the middle section of the low-pressure column 6. The nitrogen gas separated to the head of the high-pressure column 5 is withdrawn to the passage 19 connected to the top of the column 5 to be introduced into the main condenser-evaporator 7.

The liquid nitrogen formed in the main condenser-evaporator 7 is withdrawn to the passage 20, and after it is partly passed through the passage 21 and the supercooler 72 and is expanded through the pressure reducing valve 22, it is introduced to the head of the low-pressure column. The rest of the liquid nitrogen passes through the passage 23 branched out of the passage 20 to be introduced to the head of the high-pressure column 5.

The nitrogen gas separated to the head of the low-pressure column 6 is withdrawn to the passage 24 to be introduced through the supercooler 72 to the main heat exchanger 4. The nitrogen gas is subjected to heat exchange with the feed air in the main heat exchanger 4 to be warmed and then withdrawn to the passage 25.

The liquid oxygen separated to the sump of the low-pressure column 6 is partly withdrawn from the space above the cleaning section 8 to the liquid oxygen supply passage 9 to be introduced into the main condenser-evaporator 7. The oxygen gas formed in the main condenser-evaporator 7 passes through the oxygen gas introducing passage 10 by the liquid reservoir 71 to be introduced to the space under the cleaning section 8.

The rest of the liquid oxygen flows down through the cleaning section 8 to be brought into gas-liquid contact with the oxygen gas flowing up through the cleaning section 8, and thus hydrocarbons contained in the oxygen gas are removed. The liquid oxygen in which hydrocarbons are dissolved by the cleaning operation is stored in the liquid reservoir 71 and withdrawn to the liquid oxygen withdrawing passage 11.

Meanwhile, the feed air is partly diverted to a passage 73 at the middle of the main heat exchanger 4, expanded through an expansion turbine 74 to produce refrigeration and then introduced through a passage 75 to the middle section of the low-pressure column 6. Further, the feed air present upstream the main heat exchanger 4 is partly diverted to a passage 76, and after it is boosted by a booster 77 and then cooled by the main heat exchanger 4, it is expanded through an expansion valve 78 to be introduced through a passage 79 to the high-pressure column 5.

The main heat exchanger 4 may be divided into two sections: a section where the compressed feed air is subjected to heat exchange with the nitrogen gas and a section where the compressed feed air is subjected to heat exchange with the liquid oxygen.

Tables 1 to 3 show comparison between the apparatus shown in the second embodiment of the invention and the prior art apparatus having neither a cleaning section nor a sub condenser-evaporator. Table 1 shows operating conditions and hydrocarbon levels in the liquid oxygen; Table 2 shows operating conditions and the like of the main condenser-evaporator; and Table 3 shows operating conditions and the like of the sub condenser-evaporator.

Incidentally, submergence in the main condenser-evaporator in the apparatus of the second embodiment was set at 0 mm; whereas that in the prior art was set at 2,000 mm. The liquid level pressure was set at 0.6 kg/cm$^2$ in both cases. Meanwhile, the pressure loss between the compressor to the head of the high-pressure column was set to 4,000 mmAq.

TABLE 1

| | | Unit | Second embodiment | Prior art |
|---|---|---|---|---|
| Flow rate of feed air | | Nm$^3$/h | 10,000 | 10,000 |
| Flow rate of oxygen gas | | Nm$^3$/h | 1,980 | 1,980 |
| Flow rate of liquid oxygen | | Nm$^3$/h | 20 | 20 |
| Hydrocarbon concentration of liquid oxygen in main condenser-evaporator | Methane | volume ppm | 2 | 60 |
| | Ethane | volume ppm | 0.02 | 8 |
| | Propane | volume ppm | 0.02 | 4 |
| Hydrocarbon concentration of liquid oxygen in sub condenser-evaporator | Methane | volume ppm | 60 | |
| | Ethane | volume ppm | 8 | |
| | Propane | volume ppm | 4 | |

TABLE 2

| | | Unit | Second embodiment | Prior art |
|---|---|---|---|---|
| Main condenser-evaporator liquid oxygen level | Pressure | kg/cm$^2$G | 0.6 | 0.6 |
| | Temp. | °C. | −178.7 | −178.7 |
| Depth of main condenser-evaporator liquid oxygen | | mm | 0 | 2,000 |
| Main condenser-evaporator under-core liquid oxygen | Pressure | kg/cm$^2$G | 0.6 | 0.8 |
| | Temp. | °C. | −178.7 | −177.3 |
| Average temperature difference | | °C. | 0.9 | 1.3 |
| Lower column overhead nitrogen gas | Pressure | kg/cm$^2$G | 4.6 | 5.1 |
| | Temp. | °C. | −177.8 | −176.7 |
| Delivery pressure of feed air from compressor | | kg/cm$^2$G | 5.0 | 5.5 |
| Power ratio | | % | 96 | 100 |

TABLE 3

| | | Unit | Second embodiment |
|---|---|---|---|
| Sub condenser-evaporator liquid oxygen level | Pressure | kg/cm$^2$G | 0.43 |
| | Temp. | °C. | −179.8 |
| Depth of sub condenser-evaporator liquid oxygen | | mm | 2,000 |
| Sub condenser-evaporator under-core liquid oxygen | Pressure | kg/cm$^2$G | 0.65 |
| | Temp. | °C. | −178.4 |
| Average temperature difference | | °C. | 1.3 |

As shown in Table 1, in the case of the apparatus according to the second embodiment of the invention, hydrocarbon concentration values of the liquid oxygen in the main condenser-evaporator are not higher than those of hydrocarbons each measured under the vapor pressure: methane≦11 volume %, ethane≦18 volume ppm and propane≦0.07 volume ppm. Accordingly, the wall surface of the heat exchanger need not be washed with liquid oxygen, whereby to enable reduction of submergence.

As shown in Table 2, in the case of the apparatus according to the second embodiment of the invention, rise in the temperature of the liquid oxygen under the main condenser-evaporator core can be reduced by reducing submergence of the main condenser-evaporator. Accordingly, even if the temperature difference is reduced, sufficient difference can be secured between the temperature of the liquid oxygen under the core and that of the nitrogen gas, and thus the temperature of the nitrogen gas can be lowered compared with the prior art. Thus, the pressure of nitrogen gas at the head of the high-pressure column can be lowered, so that the delivery pressure of the feed air from the compressor can be lowered, leading to reduction in the power consumption cost of the compressor.

Further, as shown in Table 3, in the case of the apparatus according to the second embodiment of the invention, since the liquid oxygen is subjected to pressure reduction before it is introduced to the sub condenser-evaporator, sufficient temperature difference can be secured employing the nitrogen gas of the conditions described above is employed as such, even if submergence is increased to cause rise in the temperature of the liquid oxygen under the core, so that no loss of heat exchange efficiency occurs.

Although some embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope of the appended claims.

What is claimed is:

1. An air liquefaction separation process comprising:

a compression step of compressing a feed air;

a purification step of purifying the compressed feed air;

a cooling step of cooling the purified feed air;

a rectifying step of introducing the cooled feed air to a double rectification column to effect liquefaction, rectification and separation;

a condensation-evaporation step of subjecting a nitrogen gas separated at the head of a high-pressure column of said double rectification column and a liquid oxygen separated to the sump of a low-pressure column of said rectification column to heat exchange with each other in a main condenser-evaporator to effect liquefaction of the nitrogen gas and gasification of the liquid oxygen;

wherein said low-pressure column has a cleaning section at a lower position; the liquid oxygen is partly withdrawn from a space above said cleaning section to be supplied to said main condenser-evaporator where it is substantially entirely gasified without circulation of liquid flow; the oxygen gas formed in said main condenser-evaporator is introduced to a space under said cleaning section so as to clean the oxygen gas ascending through said cleaning section by bringing it into contact with the rest of liquid oxygen descending through said cleaning section so as to remove hydrocarbons contained in the oxygen gas; and the liquid oxygen passed through said cleaning section is withdrawn from said low-pressure column.

2. The air liquefaction separation method according to claim 1, wherein the liquid oxygen withdrawn from the sump of said low-pressure column is boosted by a pump, gasified and warmed to be discharged as a product oxygen gas.

3. The air liquefaction separation method according to claim 1, wherein the liquid oxygen withdrawn from the sump of said low-pressure column is gasified by introducing it to a sub condenser-evaporator disposed independent of said main condenser-evaporator.

4. The air liquefaction separation method according to claim 1, wherein the level of the liquid oxygen set in said main condenser-evaporator is equal to or less than the height of a heat exchanger block of said main condenser-evaporator.

5. The air liquefaction separation method according to claim 1, wherein the level of the liquid oxygen in said main condenser-evaporator is set to 50% or less than the height of the heat exchanger block in said main condenser-evaporator.

6. An air liquefaction separation apparatus comprising:

compressing means for compressing a feed air;

purifying means for purifying the compressed feed air;

cooling means for cooling the purified feed air;

a double rectification column where the cooled feed air is subjected to liquefaction, rectification and separation; and a main condenser-evaporator where a nitrogen gas separated to the head of a high-pressure column of said double rectification column and a liquid oxygen separated to the sump of a low-pressure column of said double rectification column are subjected to heat exchange to effect liquefaction of the nitrogen gas and gasification of the liquid oxygen;

wherein a cleaning section for cleaning the oxygen gas by washing it with the liquid oxygen to remove hydrocarbons contained in the oxygen gas is located at a lower position in said low-pressure column; a liquid oxygen supply passage for withdrawing partly the liquid oxygen flowing down through said low-pressure column to supply it to said main condenser-evaporator is located above said cleaning section; an oxygen gas introducing passage for introducing the oxygen gas formed in said main condenser-evaporator to the space under said cleaning section is provided below said cleaning section; and a liquid oxygen withdrawing passage for withdrawing the liquid oxygen passed through said cleaning section is located below said cleaning section.

7. The air liquefaction separation apparatus according to claim 6, wherein said cleaning section is constructed of a rectifying tray or a packing.

8. The air liquefaction separation apparatus according to claim 6, wherein said liquid oxygen withdrawing passage is provided with a pump for boosting the liquid oxygen; a heat exchange passage for achieving gasification and warming of the liquid oxygen boosted by said pump; and an oxygen gas withdrawing passage for withdrawing the thus gasified and warmed oxygen gas.

9. The air liquefaction separation apparatus according to claim 6, wherein said main condenser-evaporator is disposed out of said high-pressure column and said low-pressure column.

10. The air liquefaction separation apparatus according to claim 6, wherein said liquid oxygen withdrawing passage has a sub condenser-evaporator for gasifying the liquid oxygen to form an oxygen gas.

11. The air liquefaction separation apparatus according to claim 6, wherein said liquid oxygen withdrawing passage has a flow control valve for controlling the amount of liquid oxygen to be supplied.

* * * * *